US005924516A

United States Patent [19]

Sagaser et al.

[11] Patent Number: 5,924,516

[45] **Date of Patent: *Jul. 20, 1999**

[54] ELECTRONIC CONTROLS ON A SKID STEER LOADER

[75] Inventors: Thomas M. Sagaser, Bismark; Kenneth A. Brandt, Fargo; Scott B. Jacobson, Kindred; Knute K. Brock, Bismark, all of N. Dak.

[73] Assignee: Clark Equipment Company, Woodcliff Lake, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/585,509

[22] Filed: Jan. 16, 1996

[51] Int. Cl.[6] ..... F15B 13/16

[52] U.S. Cl. ..... 180/333; 137/625.65; 91/363 R; 414/694; 414/699

[58] Field of Search ..... 137/625.65; 37/348; 91/361, 363 R, 1; 92/5 R; 414/697, 698, 699, 700, 701, 702, 706, 708, 694; 180/333

[56] References Cited

U.S. PATENT DOCUMENTS

| | | | |
|---|---|---|---|
| 2,899,022 | 8/1959 | White | 188/2 |
| 3,253,669 | 5/1966 | Schuetz | 180/41 |
| 3,257,013 | 6/1966 | Arnold | 214/131 |
| 3,272,280 | 9/1966 | Schuetz | 180/77 |
| 3,301,088 | 1/1967 | White | 74/560 |
| 3,319,817 | 5/1967 | Juhl et al. | 214/778 |
| 3,388,821 | 6/1968 | White, Jr. | 214/778 |
| 3,403,573 | 10/1968 | Westby et al. | 74/469 |
| 3,614,273 | 10/1971 | Wallace | 214/778 |
| 3,703,931 | 11/1972 | Page et al. | 172/4.5 |
| 3,721,357 | 3/1973 | Williamson | 214/138 |
| 3,726,428 | 4/1973 | Lark et al. | 414/699 |
| 3,800,969 | 4/1974 | Steiger | 214/778 |
| 3,893,346 | 7/1975 | Paul | 74/471 R |
| 3,963,051 | 6/1976 | Kuhlmann | 137/637 |
| 4,015,729 | 4/1977 | Parquet et al. | 414/699 |
| 4,037,519 | 7/1977 | Muller et al. | 91/1 |
| 4,043,416 | 8/1977 | Albright et al. | 180/6.48 |
| 4,090,411 | 5/1978 | Albright et al. | 414/699 |
| 4,140,144 | 2/1979 | Dowd et al. | 137/15 |
| 4,274,038 | 6/1981 | Sawyer | 318/663 |

(List continued on next page.)

FOREIGN PATENT DOCUMENTS

| | | |
|---|---|---|
| 0 361 666 | 4/1990 | European Pat. Off. . |
| 0 598 937 A1 | 6/1994 | European Pat. Off. . |
| 0 628 976 A1 | 12/1994 | European Pat. Off. . |
| 20 50 667 | 11/1971 | Germany . |
| 26 07 125 | 9/1976 | Germany . |
| 44 32 237 A1 | 12/1995 | Germany . |
| WO 84/01445 | 4/1984 | WIPO . |
| WO 91/03606 | 3/1991 | WIPO . |

OTHER PUBLICATIONS

"Maximising Mini Excavator Performance", *Industrial Vehicle Technology '95,* admitted prior art.

*Primary Examiner*—Anne Marie Boehler
*Attorney, Agent, or Firm*—Westman, Champlin & Kelly, P.A.

[57] ABSTRACT

A control system controls actuation of a hydraulic cylinder on a skid steer loader. The control system includes a movable element, movable by an operator. A position sensor is coupled to the movable element and provides a position signal indicative of a position of the movable element. A controller is coupled to the position sensor to receive the position signal and provide a control signal based on the position signal. A valve spool controls flow of hydraulic fluid to the hydraulic cylinder. An actuator is coupled to the controller and the valve spool and moves the valve spool in response to the control signal from the controller.

16 Claims, 14 Drawing Sheets

U.S. PATENT DOCUMENTS

| | | | |
|---|---|---|---|
| 4,299,137 | 11/1981 | Malecha | 74/512 |
| 4,332,177 | 6/1982 | Andresen | 74/491 |
| 4,398,861 | 8/1983 | Shimole | 414/694 |
| 4,405,280 | 9/1983 | Cochran et al. | 414/685 |
| 4,476,954 | 10/1984 | Johnson et al. | 180/333 |
| 4,499,963 | 2/1985 | Liston | 180/90.6 |
| 4,523,514 | 6/1985 | Burk | 92/5 R |
| 4,531,082 | 7/1985 | Yoshinada et al. | 318/663 |
| 4,541,497 | 9/1985 | Riediger et al. | 180/6.48 |
| 4,552,055 | 11/1985 | Foxwell | 92/5 R |
| 4,646,778 | 3/1987 | Tsuji et al. | 137/270 |
| 4,702,520 | 10/1987 | Whisler et al. | 297/417 |
| 4,705,449 | 11/1987 | Christianson et al. | 414/68.5 |
| 4,706,776 | 11/1987 | Hyoki et al. | 180/334 |
| 4,736,647 | 4/1988 | Shimoie et al. | 74/471 |
| 4,844,685 | 7/1989 | Sagaser | 414/700 |
| 4,869,337 | 9/1989 | Wagner | 180/330 |
| 4,899,097 | 2/1990 | Chapman | 318/663 |
| 4,910,662 | 3/1990 | Heiser et al. | 364/167.01 |
| 4,931,710 | 6/1990 | DeVara et al. | 318/663 |
| 4,949,805 | 8/1990 | Mather et al. | 180/333 |
| 5,012,722 | 5/1991 | McCormick | 91/361 |
| 5,065,326 | 11/1991 | Sahm | 414/699 |
| 5,078,568 | 1/1992 | Lynnes | 414/680 |
| 5,083,894 | 1/1992 | Ikari et al. | 414/700 |
| 5,097,628 | 3/1992 | Kobayashi | 74/471 |
| 5,138,756 | 8/1992 | Johnson et al. | 29/401.1 |
| 5,174,115 | 12/1992 | Jacobson et al. | 60/484 |
| 5,178,510 | 1/1993 | Hanamoto et al. | 414/699 |
| 5,187,993 | 2/1993 | Nicholson et al. | 74/89.15 |
| 5,189,940 | 3/1993 | Hosseini et al. | 91/361 |
| 5,197,347 | 3/1993 | Moffitt et al. | 74/481 |
| 5,205,181 | 4/1993 | Wright | 74/480 |
| 5,232,057 | 8/1993 | Renard | 172/812 |
| 5,244,066 | 9/1993 | Mackoway et al. | 192/13 R |
| 5,263,901 | 11/1993 | Kawakami et al. | 180/6.48 |
| 5,288,198 | 2/1994 | Mozingo | 414/685 |
| 5,308,219 | 5/1994 | Lee et al. | 414/699 |
| 5,316,435 | 5/1994 | Mozingo | 414/685 |
| 5,333,533 | 8/1994 | Hosseini | 91/361 |
| 5,347,448 | 9/1994 | Nam | 414/699 |
| 5,409,188 | 4/1995 | Takagi et al. | 91/361 |
| 5,425,431 | 6/1995 | Brandt et al. | 180/273 |
| 5,426,874 | 6/1995 | Nakata et al. | 414/699 |
| 5,617,723 | 4/1997 | Hosseini | 91/361 |

100
106
112
78B
108
102
126
126
100
94
4E
4E
96
78A
94
86
92
126
126
132
76
130
128
78A
120
82
134

ELECTRONIC CONTROLS ON A SKID STEER LOADER

INCORPORATION BY REFERENCE

The following U.S. Patents are hereby incorporated by reference:

U.S. Pat. No. 5,425,431, issued on Jun. 20, 1995, to Brandt et al., entitled INTERLOCK CONTROL SYSTEM FOR POWER MACHINE, assigned to the same assignee as the present application; and U.S. Pat. No. 5,187,993 issued on Feb. 23, 1993, to Nicholson et al.

U.S. Pat. No. 5,577,876, issued on Nov. 26, 1996 entitled "HYDRAULIC INTERLOCK SYSTEM" and assigned to the same assignee as the present application.

BACKGROUND OF THE INVENTION

The present invention deals with power machines. More specifically, the present invention deals with electronic controls of hydraulic cylinders on a skid steer loader.

Power machines, such as skid steer loaders, typically have a frame which supports a cab or operator compartment and a movable lift arm which, in turn, supports a work tool such as a bucket. The movable lift arm is pivotally coupled to the frame of the skid steer loader and is powered by power actuators which are commonly hydraulic cylinders. In addition, the tool is coupled to the lift arm and is powered by one or more additional power actuators which are also commonly hydraulic cylinders. An operator manipulating a skid steer loader raises and lowers the lift arm and manipulates the tool, by actuating the hydraulic cylinders coupled to the lift arm, and the hydraulic cylinder coupled to the tool. Manipulation of the lift arm and tool is typically accomplished through manual operation of foot pedals or hand controls which are attached by mechanical linkages to valves (or valve spools) which control operation of the hydraulic cylinders.

Skid steer loaders also commonly have an engine which drives a hydraulic pump. The hydraulic pump powers hydraulic traction motors which provide powered movement of the skid steer loader. The traction motors are commonly coupled to the wheels through a drive mechanism such as a chain drive. A pair of steering levers are typically provided in the operator compartment which are movable fore and aft to control the traction motors driving the sets of wheels on either side of the skid steer loader. By manipulating the steering levers, the operator can steer the skid steer loader and control the loader in forward and backward directions of travel.

It is also common for the steering levers in the operator compartment of the skid steer loader to have hand grips which support a plurality of buttons or actuable switches. The switches are actuable by the operator and are configured to perform certain functions.

SUMMARY OF THE INVENTION

A control system controls actuation of a hydraulic cylinder on a skid steer loader. The control system includes a movable element, such as a foot pedal or a hand grip mounted to a first of a plurality of steering levers. A position sensor is coupled to the moveable element and provides an element position signal indicative of a position of the movable element. A controller is coupled to the position sensor to receive the element position signal and provide a control signal based on the element position signal. A valve spool controls flow of hydraulic fluid to the hydraulic cylinder. An actuator is coupled to the controller and the valve spool and moves the valve spool in response to the control signal from the controller.

BRIEF DESCRIPTION OF THE DRAWINGS

FIGS. 2 and 2A are block diagrams of a control system in accordance with the present invention.

DETAILED DESCRIPTION OF THE PREFERRED EMBODIMENTS

Overview

Figure 1:
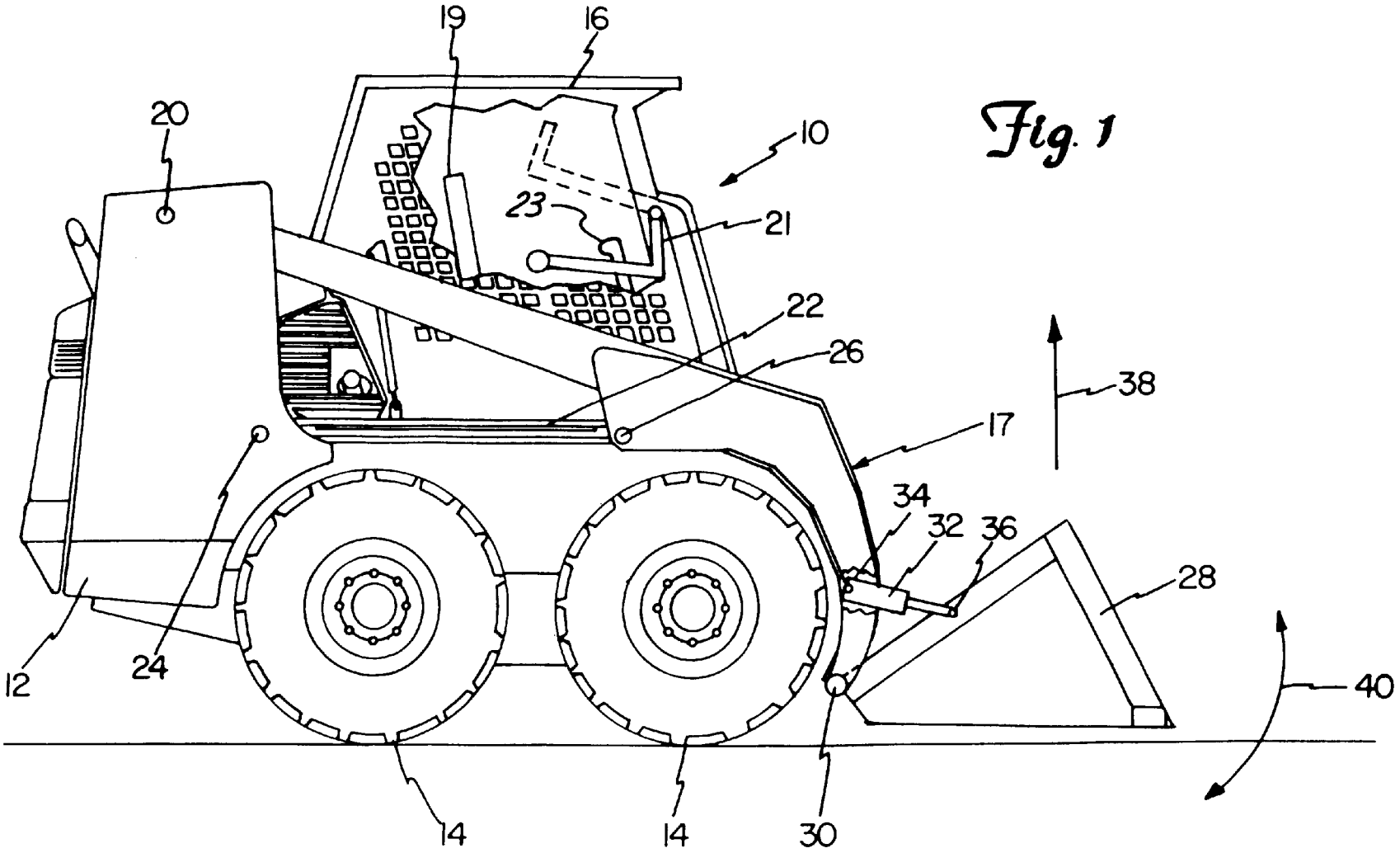
FIG. 1 is a side view of a skid steer loader according to the present invention.

FIG. 1 is a side elevational view of a skid steer loader 10 according to the present invention. Skid steer loader 10 includes a frame 12 supported by wheels 14. Frame 12 also supports a cab 16 which defines an operator compartment and which substantially encloses a seat 19 on which an operator sits to control skid steer loader 10. A seat bar 21 is pivotally coupled to a front portion of cab 16. When the operator occupies seat 19, the operator then pivots seat bar 21 from the raised position (shown in phantom in FIG. 1) to the lowered position shown in FIG. 1.

A pair of steering levers 23 (only one of which is shown in FIG. 1) are mounted within cab 16. Levers 23 are manipulated by the operator to control forward and rearward movement of skid steer loader 10, and in order to steer skid steer loader 10.

A lift arm 17 is coupled to frame 12 at pivot points 20 (only one of which is shown in FIG. 1, the other being identically disposed on the opposite side of loader 10). A pair of hydraulic cylinders 22 (only one of which is shown in FIG. 1) are pivotally coupled to frame 12 at pivot points 24 and to lift arm 17 at pivot points 26. Lift arm 17 is coupled to a working tool which, in this preferred embodiment, is a bucket 28. Lift arm 17 is pivotally coupled to bucket 28 at pivot points 30. In addition, another hydraulic cylinder 32 is pivotally coupled to lift arm 17 at pivot point 34 and to bucket 28 at pivot point 36. While only one cylinder 32 is shown, it is to be understood that any desired number of cylinders can be used to work bucket 28 or any other suitable tool.

The operator residing in cab 16 manipulates lift arm 17 and bucket 28 by selectively actuating hydraulic cylinders 22 and 32. In prior skid steer loaders, such actuation was accomplished by manipulation of foot pedals in cab 16 or by actuation of hand grips in cab 16, both of which were attached by mechanical linkages to valves (or valve spools) which control operation of cylinders 22 and 32. However, in accordance with the present invention, this actuation is accomplished by moving a movable element, such as a foot pedal or a hand grip on steering lever 23, and electronically controlling movement of cylinders 22 and 32 based on the movement of the movable element.

By actuating hydraulic cylinders 22 and causing hydraulic cylinders 22 to increase in length, the operator moves lift arm 17, and consequently bucket 28, generally vertically upward in the direction indicated by arrow 38. Conversely, when the operator actuates cylinder 22 causing it to decrease in length, bucket 28 moves generally vertically downward to the position shown in FIG. 1.

The operator can also manipulate bucket 28 by actuating cylinder 32. This is also preferably done by pivoting a movable element (such as a foot pedal or a hand grip on one of levers 23) and electronically controlling cylinder 32 based on the movement of the element. When the operator causes cylinder 32 to increase in length, bucket 28 tilts forward about pivot points 30. Conversely, when the operator causes cylinder 32 to decrease in length, bucket 28 tilts rearward about pivot points 30. The tilting is generally along an arcuate path indicated by arrow 40.

System Block Diagram

1. Control System 42

Figure 2:
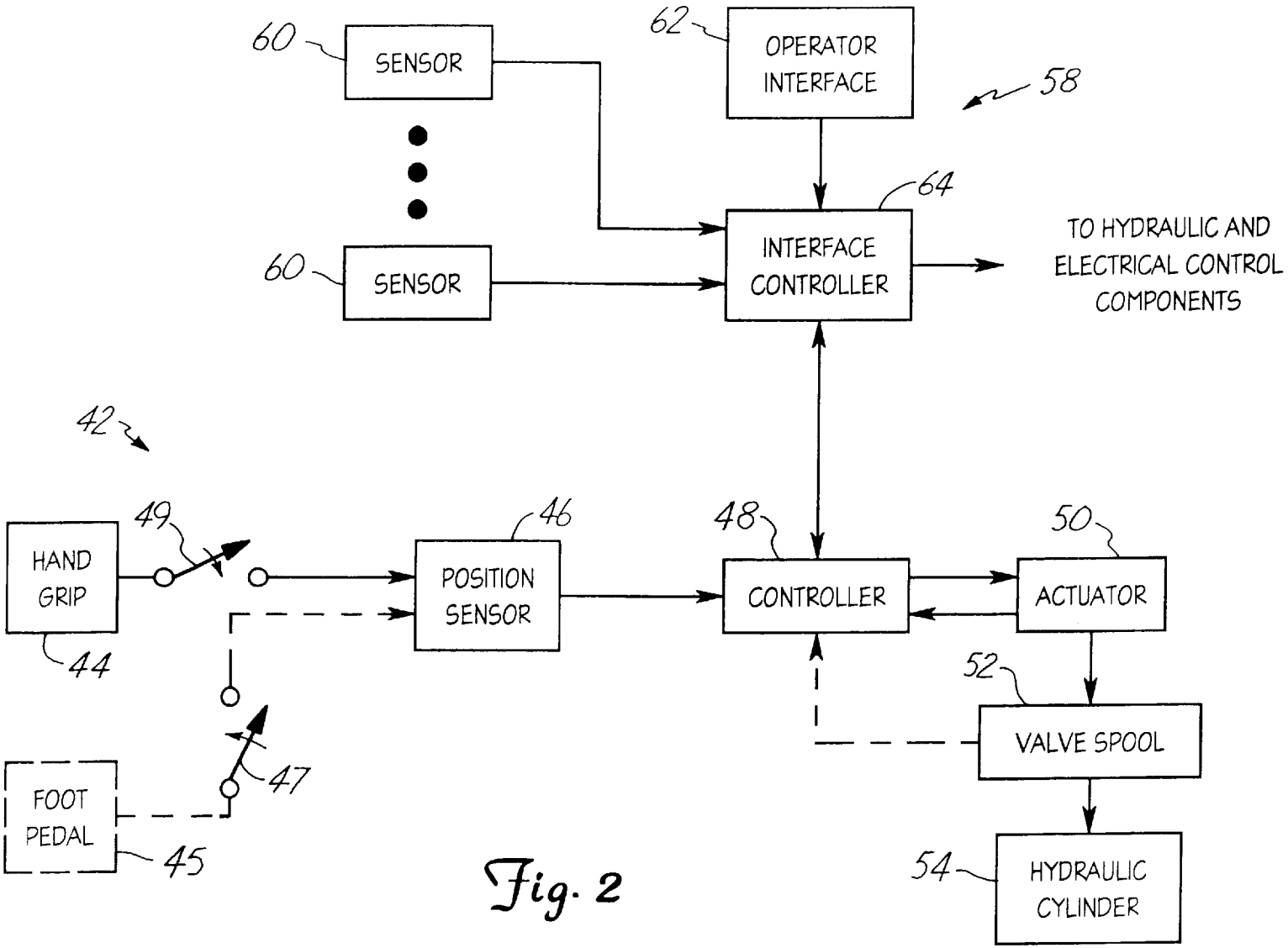

FIG. 2 is a block diagram which better illustrates operation of a control system 42 according to the present invention. Control system 42 includes an operator moveable element such as hand grip assembly 44, foot pedal assembly 45 or another suitable movable element. Control system 42 also includes position sensor 46, controller 48, actuator 50, valve spool 52 and hydraulic cylinder 54. In the preferred embodiment, control system 42 is also coupled to an interface control system 58 which includes a plurality of sensors 60, an operator interface 62 and an interface controller 64.

It should be noted that the present invention can be implemented using any suitable operator movable element. Also, a combination of elements such as movable hand grip 44 and foot pedal 45 can be provided to accomplish desired movement of hydraulic cylinders. Such movable elements can be used to accomplish movement of a number of different cylinders. FIG. 2A illustrates this embodiment which shows an additional movable element 44', an additional position sensor 46', an additional actuator 50', an additional valve spool 52' and an additional hydraulic cylinder. Also, two or more different movable elements can be provided as alternative elements usable to accomplish movement of a single cylinder. In this latter case, switches (such as optional switches 47 and 49) are provided for the operator to select the particular movable element which the operator desires to be the operator input mechanism. For the sake of clarity, the present description proceeds with respect to hand grip assembly 44 only. It should be recognized that a similar assembly can be used with a foot pedal or other movable element as well.

Hand grip assembly 44 is preferably pivotally mounted to one of steering levers 23 in loader 10. The hand grip is preferably mounted for pivoting in a direction which lies in a plane substantially transverse to the direction of movement of steering levers 23. Position sensor 46, in one preferred embodiment, is a potentiometer or resistive strip-type position sensor. As hand grip assembly 44 is pivoted, position sensor 46 senses movement of hand grip assembly 44 and provides a position signal indicative of the position of hand grip assembly 44.

Controller 48 is preferably a digital microcontroller or microcomputer, and receives the position signal from position sensor 46. In response to the position signal, controller 48 provides a control signal to actuator 50.

Actuator 50 is preferably a linear actuator which is coupled to valve spool 52 by a suitable linkage. In response to the control signal provided by controller 48, actuator 50 moves valve spool 52 in a desired direction. It should be noted that actuator 50 can also be any suitable actuator such as, for example, one which is integrally formed with the valve which it actuates or spool 52. The precise mode by which spool 52 is moved is not critical to the primary inventive features of the invention. Valve spool 52 is coupled to hydraulic cylinder 54 and controls flow of hydraulic fluid to hydraulic cylinder 54 in response to the output from actuator 50. In the preferred embodiment, hydraulic cylinder 54 is one of hydraulic cylinders 22 and 32. Therefore, control system 42 manipulates lift and tilt cylinders 22 and 32 based on pivotal movement of hand grip assembly 44.

Controller 48 also receives a feedback signal which indicates the position of valve spool 52. In one embodiment, controller 48 receives the feedback signal from actuator 50 indicating the position of actuator 50. This, in turn, indicates the position of valve spool 52. In another embodiment, controller 48 receives the feedback signal from valve spool 52 which directly indicates the position of valve spool 52. Upon receiving the feedback signal from either actuator 50 or valve spool 52, controller 48 compares the actual position of valve spool 52 to the target or input position from hand grip assembly 44 and makes necessary adjustments. Thus, controller 48 operates in a closed loop fashion. This process is described in greater detail later in the specification.

2. Interface Control System 58

Interface control system 58 is described in greater detail in U.S. Pat. No. 5,425,431, issued on Jun. 20, 1995, to Brandt et al., entitled INTERLOCK CONTROL SYSTEM FOR POWER MACHINE, assigned to the same assignee as the present application, and hereby incorporated by reference. Briefly, interface control system 58 receives input signals from a plurality of sensors 60 which indicate operating parameters such as operator presence from a seat sensor, and such as seat bar position from a seat bar sensor. Interface controller 64 also receives inputs from operator interface 62 which, in one preferred embodiment, is simply an ignition switch and a display. Based on the inputs received, interface controller 64 controls certain hydraulic and electrical components in skid steer loader 10. Interface controller 64 preferably inhibits certain operation of loader 10 until some certain combination of inputs from sensors 60 is received. For instance, upon receiving appropriate signals, interface controller 64 may enable operation of wheels 14, or may enable certain hydraulic functions performable by skid steer loader 10.

Interface controller 64 is also preferably a digital computer, microcontroller, or other suitable controller. Interface controller 64 is connected to controller 48 by a serial bus, a parallel bus, or other suitable interconnection.

3. Interaction Between Systems 42 and 58

Interface controller 64 is also configured to disable operations performable by controller 48 under certain circumstances. For example, upon power-up, interface controller 64 inhibits the operators performable by controller 48 until sensors 60 indicate that seat bar 21 is in the lowered position and that the operator is in seat 19. At that point, interface controller provides controller 48 with a signal enabling controller 48 to perform functions. If, however, sensors 60 were to indicate that the operator is not in seat 19, or that the seat bar 21 is not in the lowered position, interface controller 64 would continue to provide controller 48 with a signal inhibiting actuation of cylinders 22 or 32 until the sensors 60 provide appropriate signals.

Once sensors 60 provide signals which allow controller 64 to "unlock" controller 48, controller 48 also performs certain diagnostic or calibration functions. For instance, hand grips 44 are preferably biased to a neutral position. Upon power-up or at predetermined intervals, controller 48 determines whether hand grip 44 is in the neutral position (or within some predetermined range of the neutral position) based on the position signal from position sensor 46. If not, controller 48 preferably provides a signal to controller 64 causing controller 64 to continue to inhibit any selected operations of loader 10, such as actuation of the particular hydraulic cylinder to which controller 48 is attached, until hand grip 44 is brought into the neutral position for a suitable time period. This essentially prevents immediate actuation of cylinders 22 and 32 upon power-up of control system 42. Instead, hand grip 44 must preferably start in the neutral position at power-up, or come within the neutral position and remain there for some predetermined time period before actuation can occur.

In addition, controller 48 also initially determines whether valve spool 52 is in a neutral position or within a predetermined range of the neutral position (i.e., a position in which actuation of cylinder 54 is not taking place) based on the feedback signal. If not, interface controller 64 simply continues to lock out selected operations of loader 10. For diagnostic purposes, controller 48 may attempt to drive valve spool 52 into the neutral position by controlling actuator 50 accordingly. If controller 48 cannot drive valve spool 52 to the neutral position, controller 48 preferably signals to interface controller 64 that valve spool 52 cannot be driven to neutral. Interface controller 64 then takes appropriate action, such as disabling certain functions of skid steer loader 10 and indicating to the operator that operation will not commence until remedial action is taken.

Controller 48 also provides calibration functions. For example, upon startup, and assuming hand grip 44 and valve spool 52 are within a given range of neutral, controller 48 stores the values of the position signal from position sensor 46 and from the feedback signal as the neutral values for hand grip 44 and valve spool 52, respectively. Controller 48 then centers a control band used by controller 48 to control actuator 50 around the neutral valves. This is described in greater detail later in the specification.

While the above description has proceeded describing controllers 48 and 64 as separate controllers, it is to be understood that the functions performed by each can be combined into a single controller, or can be divided among a greater number of controllers. Such a combination or division of functions may be desirable depending on a given application.

4. Float and Detent

Controller 48 also preferably controls cylinder 54 to accomplish another function. It may be desirable, at certain times, for the operator of skid steer loader 10 to cause lift arm 17 (or the tool, such as bucket 28) to float. By floating it is meant that there is no positive hydraulic control of the particular cylinder which is floating.

For instance, the operator of skid steer loader 10 may wish to operate skid steer loader 10 so that bucket 28, and lift arm 17, follow the terrain over which loader 10 is traveling. In that case, the operator simply pivots hand grip 44 to a predetermined position (such as to one extreme end of pivoting travel), and this indicates to controller 48 that the operator wishes to cause the particular hydraulic cylinder under control to float. In response, controller 48 provides a control signal to actuator 50 causing actuator 50 to move valve spool 52 to a position which effectively connects both hydraulic inputs to hydraulic cylinder 54 together. In this way, the oil which actuates hydraulic cylinder 54 is not pressurized and is free to move from one end of cylinder 54 to the other in response to forces exerted on the cylinder by changes in the terrain. In the preferred embodiment, and as will be described later in the specification, hand grip 44 is moved to one extreme end of travel where a detent engages to hold hand grip 44 in the float position until the operator wishes to remove hand grip 44 from the float position.

Hand Grip Assembly 44

Figure 3A:
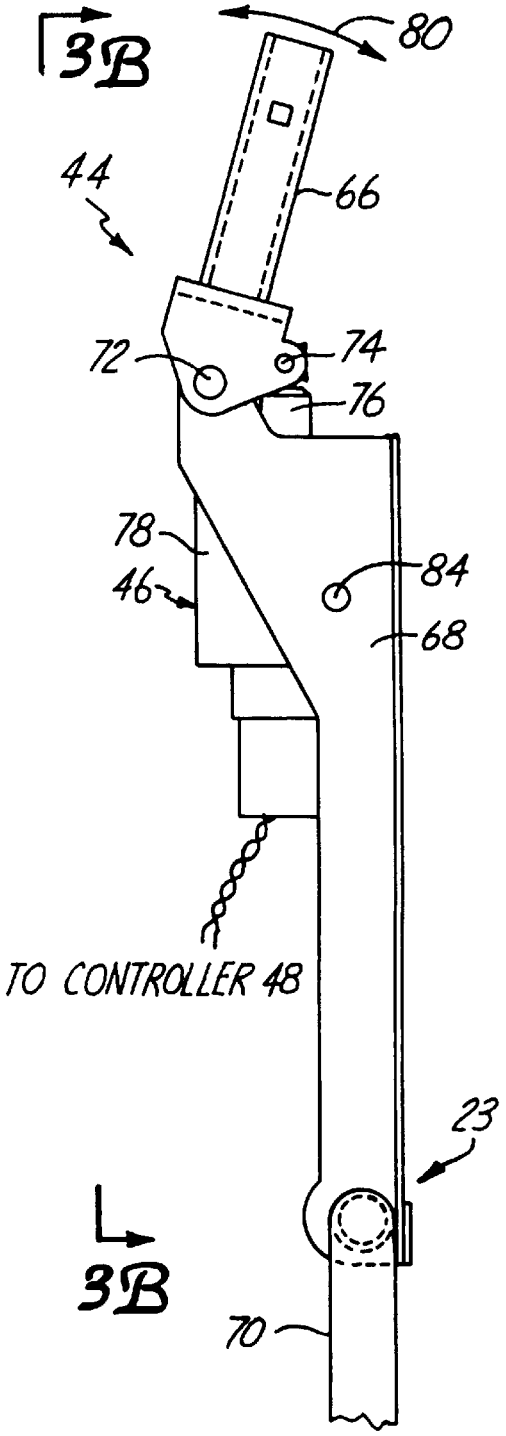
FIGS. 3A and 3B illustrate a hand grip assembly according to one embodiment of the present invention.
Figure 3B:
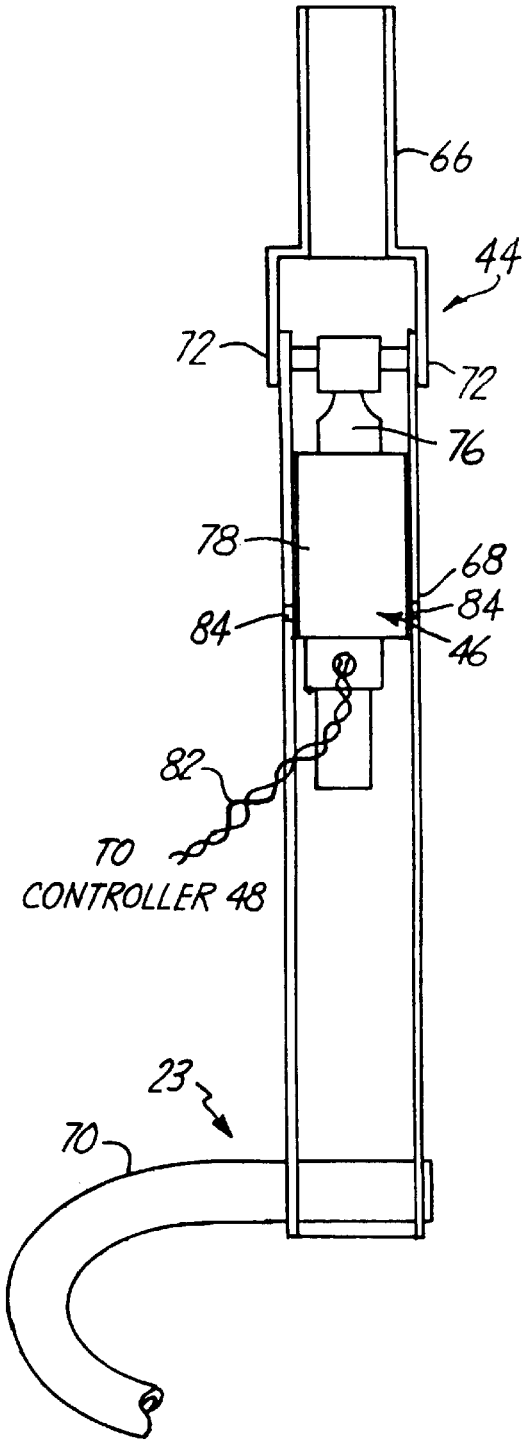

FIGS. 3A and 3B are rear and side views, respectively, of a left hand steering lever 23 including a hand grip assembly 44 according to the present invention. FIG. 3B is a view of steering lever 23 taken in the direction indicated by line 3B—3B in FIG. 3A. Hand grip assembly 44 includes handle 66 and channel arm 68. Channel arm 68 is coupled to a curved tubular member 70 which is, in turn, coupled to a lower portion of steering lever 23.

Handle 66 is pivotally coupled to channel arm 68 at pivot point 72. Position sensor 46 is mounted to channel arm 68 and is also coupled to handle 66 at pivot point 74. In the preferred embodiment, and as will be described in greater detail with respect to FIGS. 4A–4E, position sensor 46 includes a plunger 76 which is pivotally coupled to handle 66 at pivot point 74 and is reciprocable within cylinder 78. Plunger 76 is biased to a neutral position (shown in FIGS. 3A and 3B) so that handle 66 is slightly tilted inwardly from vertical (with respect to the operator) and pivotable about pivot point 72 in both directions, from the neutral position, generally in a direction indicated by arrow 80. As handle 66 is pivoted, plunger 76 reciprocates within cylinder 78. Plunger 76 and cylinder 78 have elements which interact to provide a signal on a plurality of conductors 82 which is indicative of the position of handle 66. This signal is provided to controller 48.

Position sensor 46 is pivotally mounted to channel arm 68 at pivot points 84. This is to accommodate the slight arc through which pivot point 74 travels during pivoting of handle 66.

Position Sensor 46

Figure 4A:
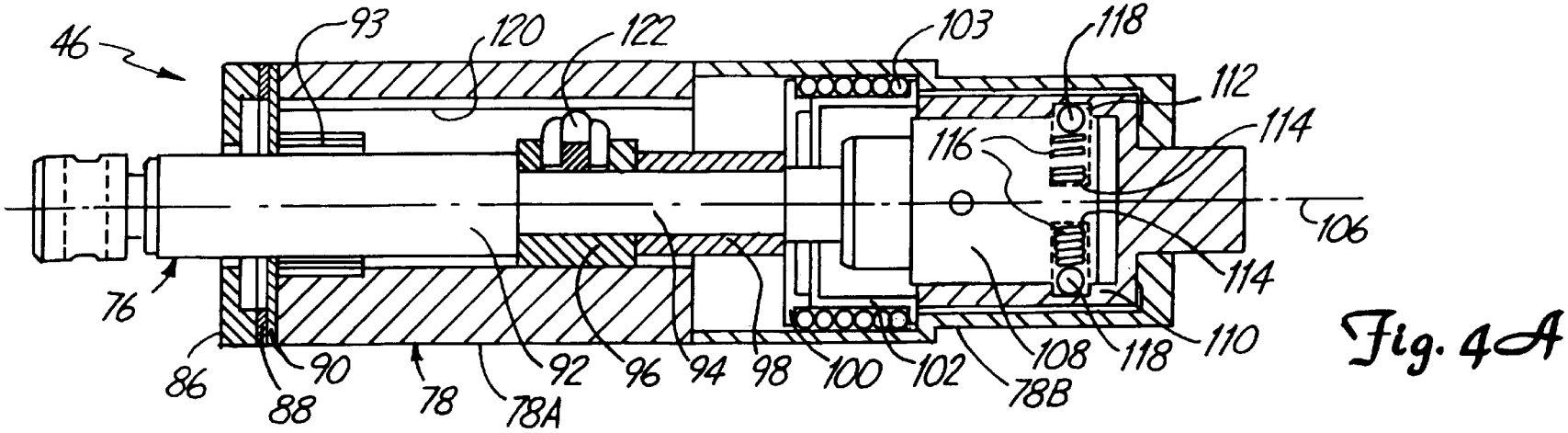
FIGS. 4A, 4B, 4C, 4D and 4E are side sectional views of a portion of the hand grip assembly according to the present invention.
Figure 4B:
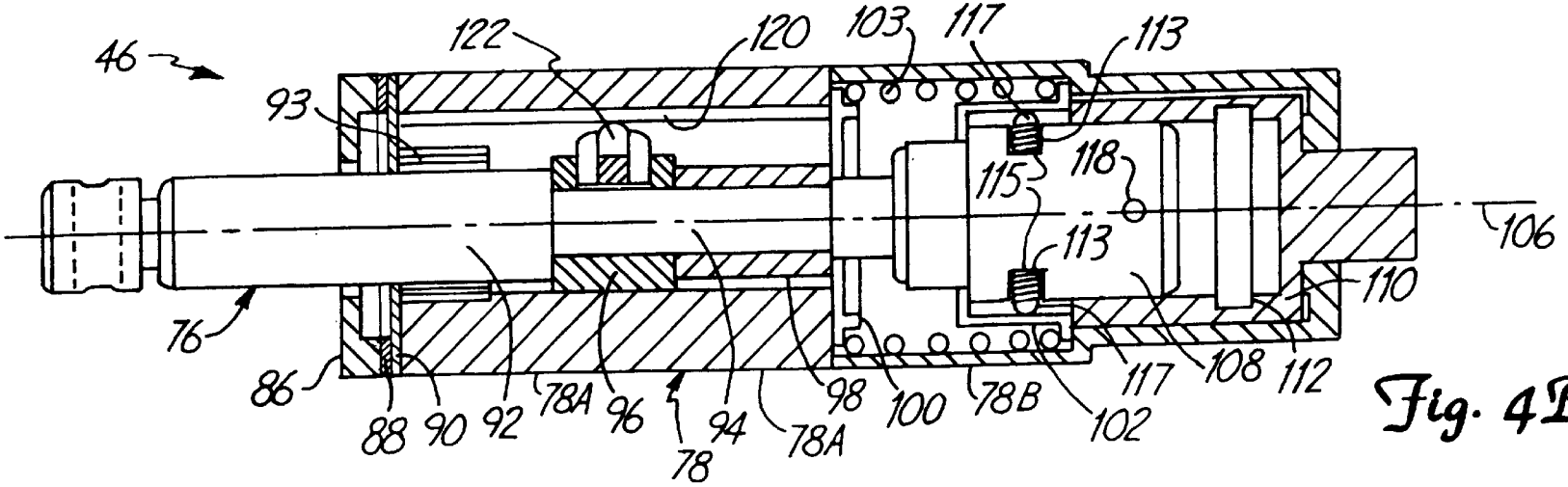
Figure 4C:
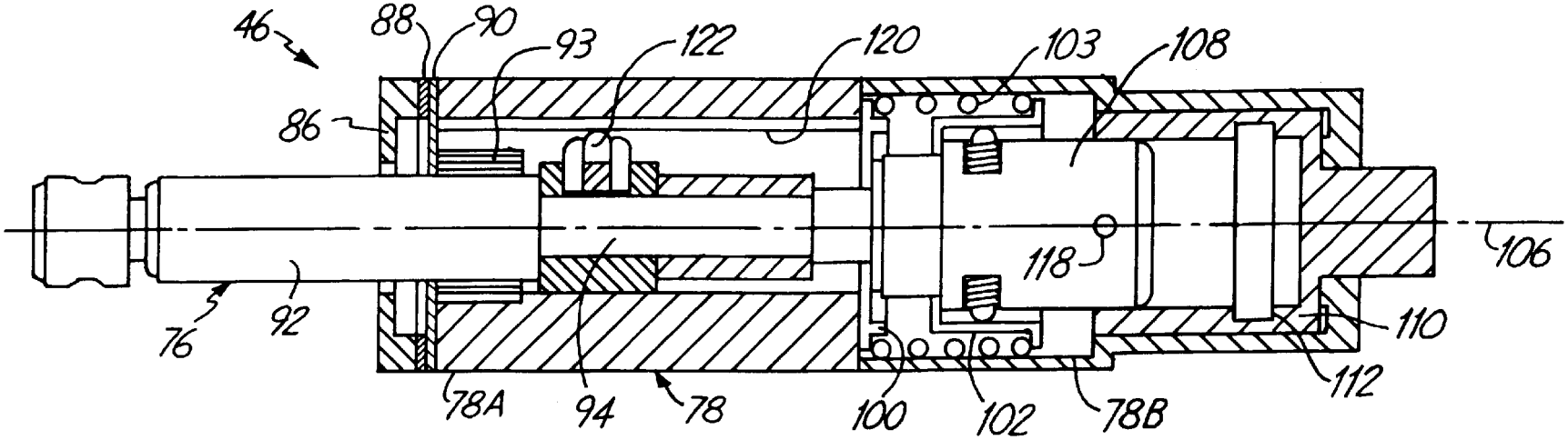
Figures 4D, 4E:
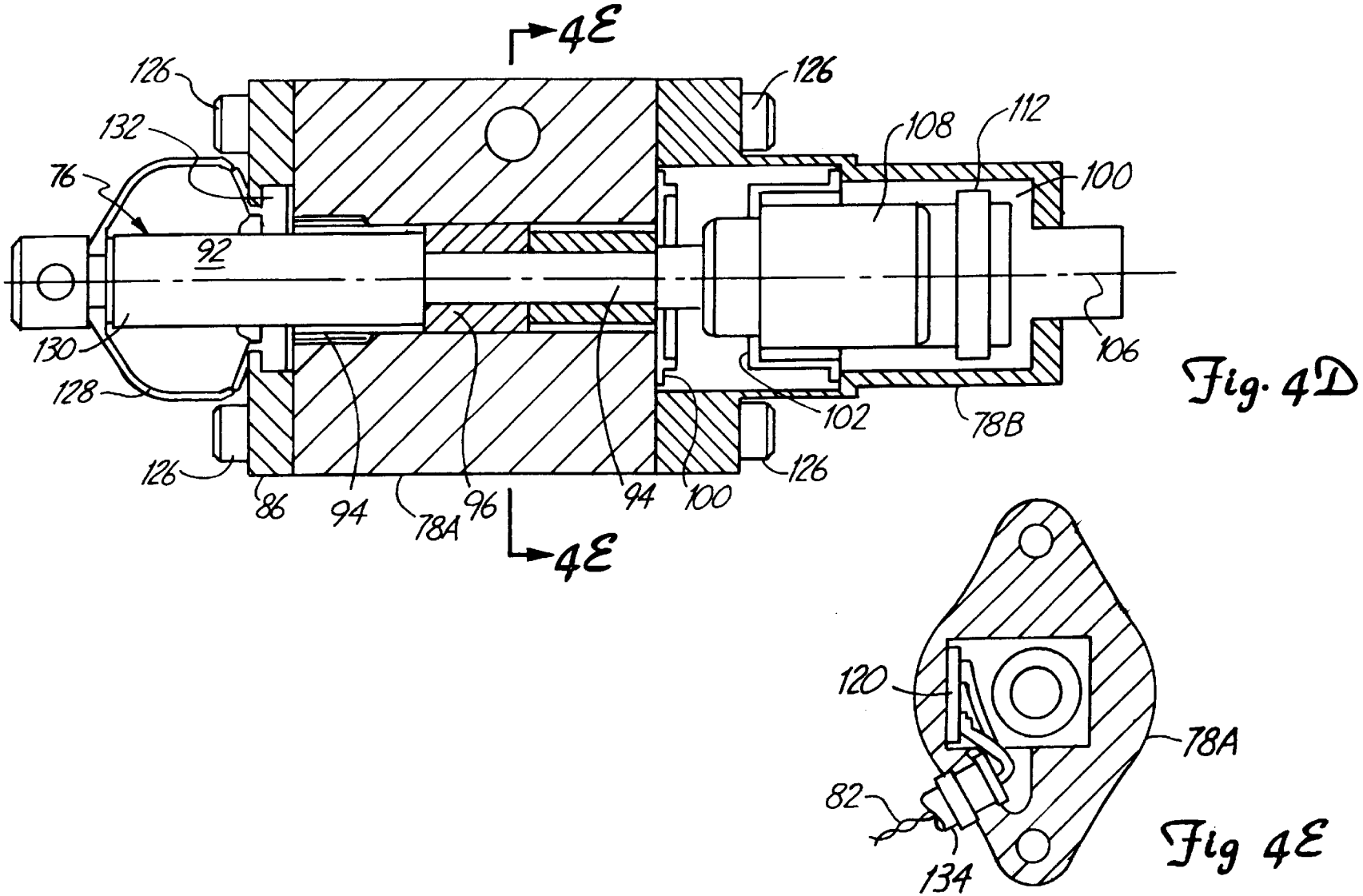
Figure 4F:
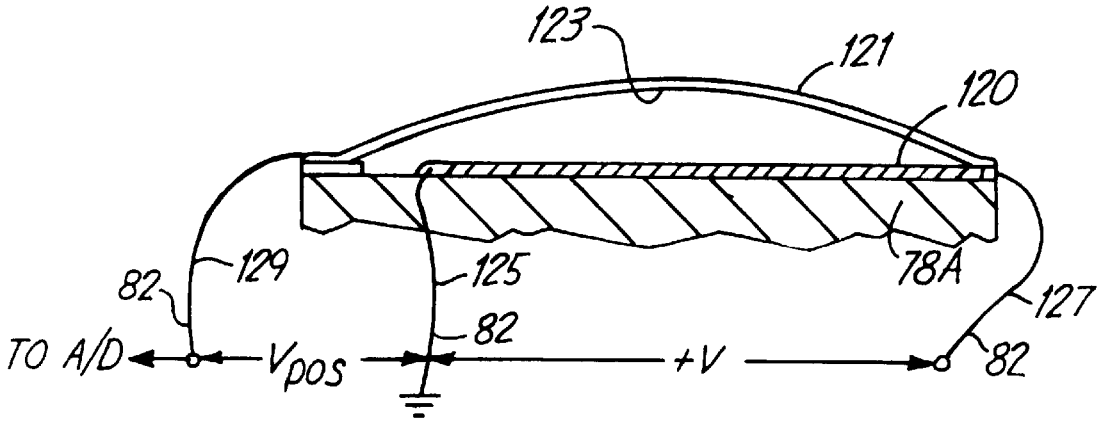
FIGS. 4F, 4G and 4H illustrate one preferred is embodiment of a resistive sensor configuration.

FIGS. 4A, 4B and 4C illustrate position sensor 46 with the outer portions of housing 78 cut away for clarity. FIGS. 4D, 4E and 4F illustrate one embodiment of position sensor 46 in partial schematic form. FIG. 4A shows position sensor 46 in the extremely retracted position, FIG. 4B shows position sensor 46 in a neutral position, and FIG. 4C shows position sensor 46 in the extremely extended position.

FIGS. 4A–4C show that housing 78 of position sensor 46 has first housing portion 78A and second housing portion 78B which are bolted together. Cap 86 is bolted to portion 78A and secures a washer 88 and gasket 90 to housing portion 78A.

Plunger 76 has a first shaft portion 92 which extends within an aperture in cap 86 and into housing portion 78A, through a spacer 93. Spacer 93 is preferably contained within housing portion 78A and may also be securely attached to housing portion 78A to position plunger 76 radially within housing 78. Plunger 76 also has a second portion 94 which carries a tab support member 96 on its outer periphery. Tab support member 96 is preferably frictionally fit on the outer periphery of shaft portion 94. A spacer block 98 is also preferably frictionally fit on the outer periphery of shaft portion 94.

A pair of annular standoffs 100 and 102 are disposed about shaft portion 94. Standoffs 100 and 102 are movable in a longitudinal direction (defined by axis 106) relative to one another and are preferably urged away from one another by a bias member (e.g., a spring) 103. Shaft portion 94 is also attached to a cylinder member 108 which moves reciprocally within a cylinder receiving cavity defined by cavity member 110 in housing portion 78B.

The cavity member 110 has an annular notch 112 formed therein. Cylinder member 108 has a pair of oppositely disposed spring receiving notches 114 formed therein. Compression springs 116 are provided in notches 114, and a small ball bearing, or detent member 118 is also provided in notches 114. Cylinder member 108 also has a second pair of oppositely disposed spring receiving notches 113 formed therein (shown in FIG. 4B). Compression springs 115 are provided in notches 113 and a small ball bearing or detent member 117 is also provided in notches 115.

As plunger 76 is moved to the extremely retracted position shown in FIG. 4A, annular standoff 100 compresses spring 103 against standoff 102 and cylinder member 108 moves toward the position shown in FIG. 4A. Detent members 117 engage a shoulder on cavity member 110 and springs 115 are compressed so detent members 117 move within notches 113. This provides the operator with a feeling of a slight change in resistance to movement of the hand grip, indicating that the hand grip is about to enter the detent position. Continued movement of cylinder member 108 causes compression springs 116 to force detent members 118 out away from the radial center of cylinder member 108. This causes detent members 118 to engage annular notch 112 formed in cavity member 110. This acts as a detent, holding plunger 76 in the extremely retracted position until the operator manually moves plunger 76 from that position by forcibly pivoting the hand grip to extend plunger 76 from within housing 78. This causes detent members 118 to retract within notches 114, compressing springs 116 so that cylinder member 108 is free to move within cavity member 110.

In the preferred embodiment, plunger 76 is biased into the neutral position shown in FIG. 4B by an appropriate bias means such as spring 103. Spring 103 forces the plunger 76 into the neutral position shown in FIG. 4B when no operator force is applied to plunger 76, and when plunger 76 is not in the detent position.

Housing portion 78A has disposed on its inner radial surface a resistive strip or film 120. A number of different sensor configurations can be used. In one preferred configuration, a conductive tab 122 is supported on tab support member 96 which is fixedly attached to plunger 76. Both resistive strip 120 and tab 122 are electrically coupled, through conductors 82 shown in FIGS. 3A, 3B and 4E, to controller 48. Essentially, tab 122 acts as a wiper along a linear potentiometer formed by tab 122 and resistive strip 120. As tab 122 moves along resistive strip 120, the signal provided to controller 48 on conductors 82 changes thus indicating the longitudinal position of plunger 76 within housing 78. Based on this position, controller 48 determines the degree to which the operator has pivoted handle 66, and the direction of the pivot. This allows controller 48 to appropriately control actuator 50 to accomplish the desired operation.

Figure 4G:
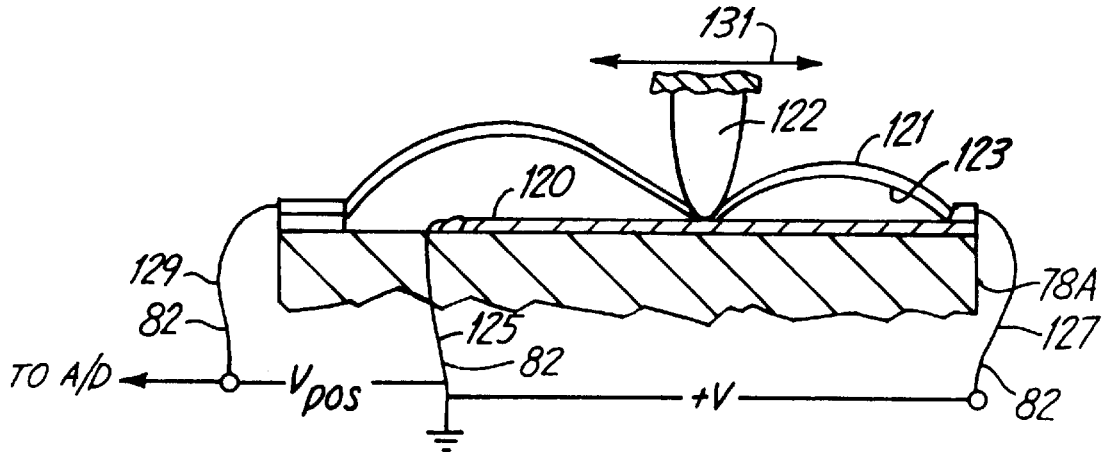
Figure 4H:
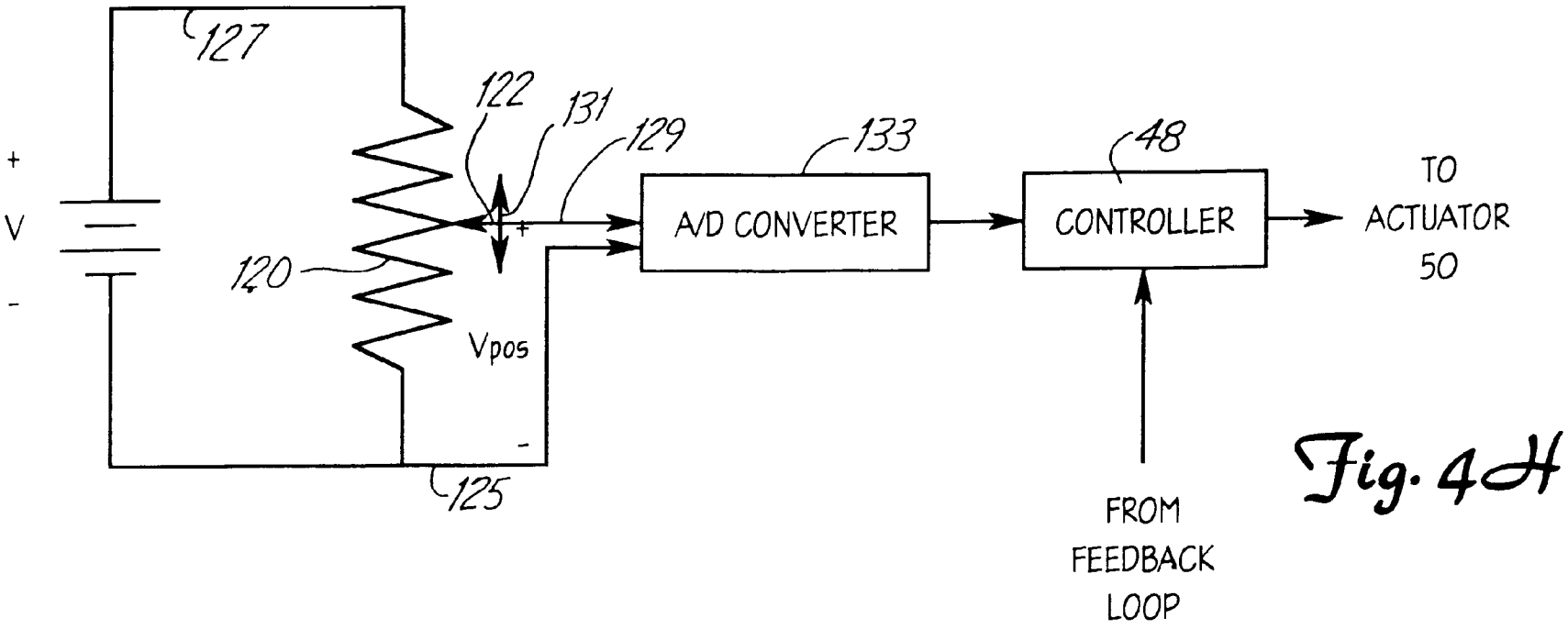

FIGS. 4F, 4G and 4H illustrate another preferred sensor configuration. FIG. 4F shows resistive strip 120 applied to the inner cylindrical surface of housing portion 78A. Resistive strip 120 is preferably applied as a resistive film. A flexible bubble-type member 121 (preferably made of mylar) is disposed above resistive strip 120 and is coated, on its interior surface, with a conductive strip or film, such as a silver metalized film 123. Both sides of resistive strip 120 preferably have conductors (such as wires or printed copper or other suitable conductors) 125 and 127 connected thereto. Silver strip 123 preferably also has a conductor 129 coupled thereto.

Operation of the configuration shown in FIG. 4F is better illustrated in FIG. 4G. A fixed voltage is preferably applied across conductors 125 and 127. This is schematically illustrated in FIG. 4H. Tab 122 (shown in FIGS. 4A–4C, is slidably disposed relative to mylar bubble 121 so that it is movable along mylar bubble 121 in the direction indicated by arrow 131 (along with reciprocal plunger 76). As tab 122 moves in the direction indicated by arrow 131, it causes a different portion of silver strip 123 to contact resistive strip 120. Controller 48 measures the signal produced as a voltage position signal ($V_{pos}$) across conductors 125 and 129. The signal $V_{pos}$ thus gives an indication of the position of tab 122 along resistive strip 120, and hence it gives an indication of the position of the plunger 76 relative to housing 78. This signal is digitized by A/D controller 133 and provided to controller 48. This allows controller 48 to appropriately control actuator 50 to accomplish the desired operation.

The output of A/D converter 133, in the preferred embodiment, is 8 digital bits representing a value ranging from 0 to 255.

Figure 6A:
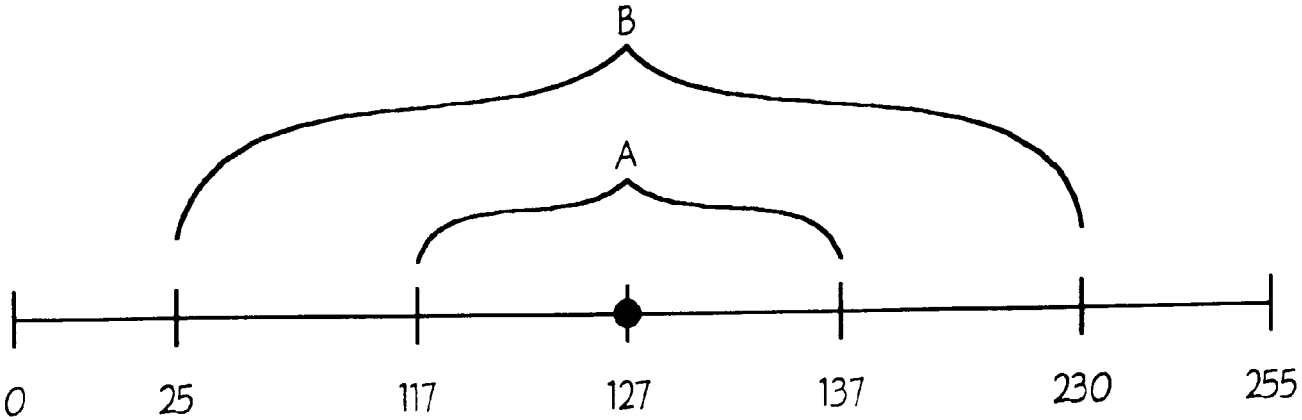
FIGS. 6A and 6B illustrate control band adjustment according to the present invention.
Figure 6B:
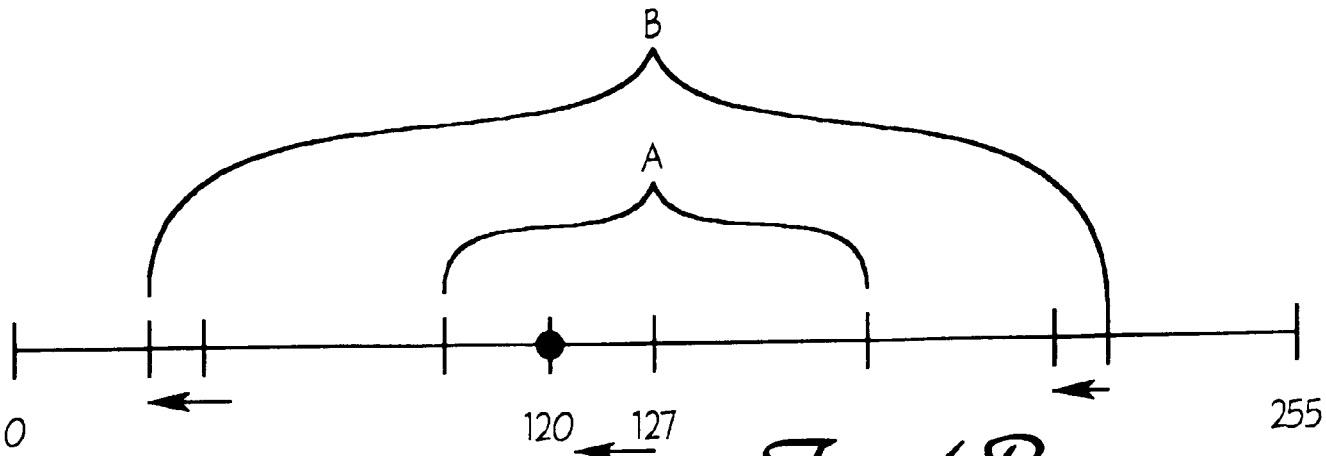

Operation and calibration of the control system is better illustrated in FIGS. 6A and 6B. At power-up, controller 48 reads the position of hand grip 44 from the A/D converter 133 in position sensor 46. If the position of hand grip 44 is within a predetermined range of neutral, such as range A shown in FIG. 6A, (i.e., if the value provided by A/D converter 133 is between 117 and 137) then controller 48 assumes that hand grip 44 is in the neutral position. In the embodiment shown in FIG. 6A, hand grip 44 is in a position corresponding to the value 127 provided by the A/D converter 133. This is within range A and controller 48 proceeds.

Controller 48 then determines whether the control band is set properly. In the embodiment shown in FIG. 6A, the control band extends from the value 25 to the value 230 and is designated by the letter B. Since the position of hand grip 44 corresponds to the value 127, which fits squarely between 25 and 230, controller 48 need not adjust control band B at all, and can simply continue with normal operation.

In the embodiment disclosed in FIG. 6B, upon power-up, controller 48 reads the A/D converter 133 and finds that the hand grip 44 is in a position corresponding with the value 120. While this is seven digits shifted to the left of the optimal center, it is still within range A. Therefore, controller 48 effectively shifts the control band B seven digits to the left and continues control.

In the preferred embodiment, rather than physically changing the boundaries of range B in memory, controller 48 simply subtracts seven digits from any number it subsequently reads from the A/D converter 133. In other words, if the operator moves hand grip 44 to a position such that the A/D converter 133 provides a value of 140, controller 48 subtracts seven to yield a result of 133. Controller 48 then operates actuator 50 as if the operator had requested actuator 50 to be moved to a position corresponding to the value 130.

In the preferred embodiment, each digit in the control band B set out in FIGS. 6A and 6B, is equal to approximately five thousands of an inch of travel of plunger 76. This will, of course, vary with different implementations of position sensor 46. In addition, in the preferred embodiment, control band B is adequate to allow 0.28 inches of movement on both sides of neutral.

Also, in the present invention, it has been found that a tolerance of one count in either direction provides adequate results. In other words, if the operator requests (through actuation of hand grip 44) that controller 48 move actuator 50 to a position corresponding to the number 16 from the A/D converter 133, then controller 48 moves actuator 50 until it is one of numbers 15, 16 or 17. This eliminates the vast majority of hunting, yet maintains adequate accuracy.

FIG. 4D is a similar illustration to that shown in FIGS. 4A–4C, except that it is rotated 90° about axis 106. FIG. 4D better illustrates the connections (by bolts 124) between housing portions 78A and 78B and cap 86.

Further, FIG. 4D illustrates another feature preferably used in accordance with the present invention. A constant volume boot 128 is preferably disposed about an upper portion of plunger 76. Boot 128 has a first end which is snugly secured above an annular shoulder 130 of plunger 76. Boot 128 also preferably has a lower portion which is snugly secured about plunger 76 within a cavity 132 defined by cap 86. Boot 128 is preferably formed of a pliable and resilient material which allows reciprocation of plunger 76 within housing 78. However, by providing boot 128, debris or other foreign matter is substantially incapable of entering housing 78 and inhibiting operation of position sensor 46.

FIG. 4E is a cross-sectional view of position sensor 46 taken along section lines 4E–4E in FIG. 4D. FIG. 4E shows that conductors 82 are preferably connected to resistive strip 120 and exit housing 78A through a conduit 134. One of conductors 82 is also preferably connected to silver strip 123, and exits through conduit 134 as well.

Figure 5A:
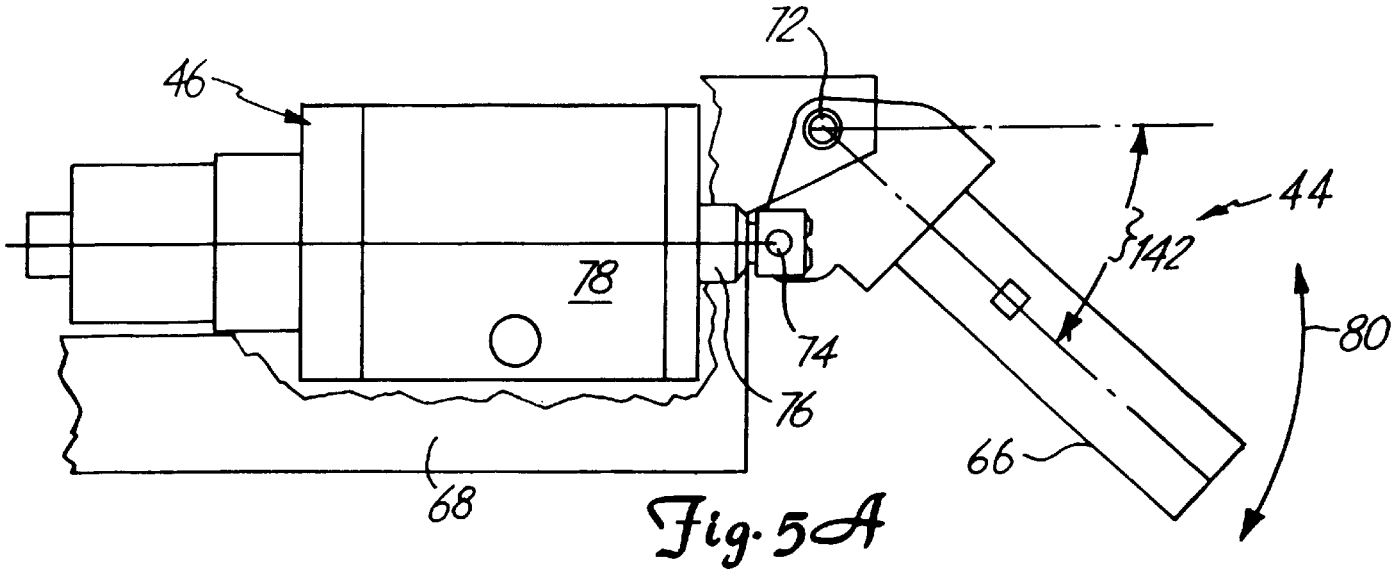
FIGS. 5A, 5B and 5C are side views of a portion of a hand grip assembly according to the present invention illustrating operation.
Figure 5B:
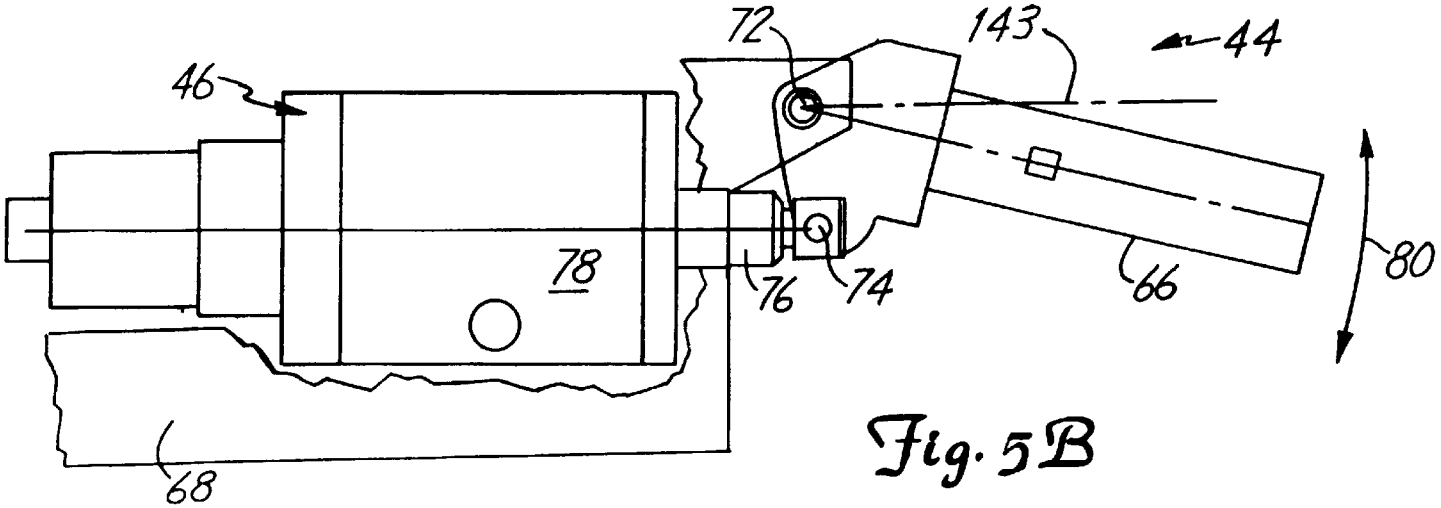
Figure 5C:
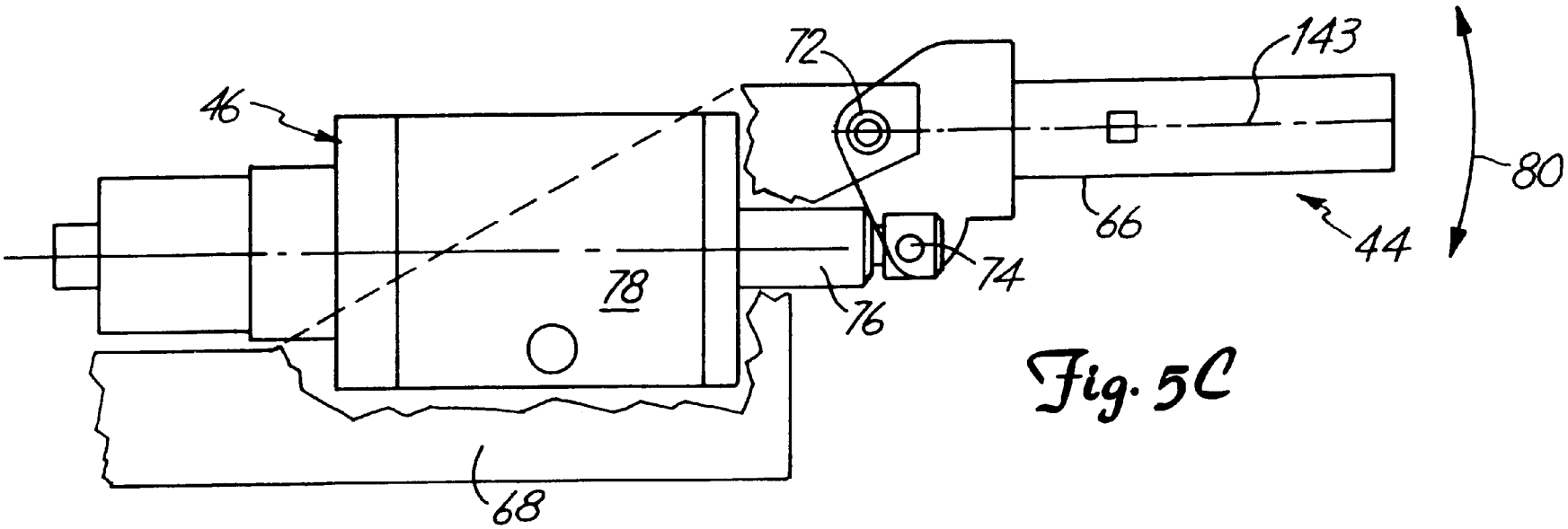

FIGS. 5A–5C are similar to FIGS. 4A–4C, except that they show handle 66 mounted to plunger 76. FIGS. 5A–5C show the extremely retracted, the neutral, and the extremely extended, positions of plunger 76 in position sensor 46, respectively. In the preferred embodiment, the extremely retracted position results from the operator pivoting handle 66 through an arc 142 which is approximately 42°. In the neutral position, the handle rests at a position which is displaced from axis 143 by approximately 14°. In the extremely extended position, handle 66 has a longitudinal axis which preferably lies on axis 143.

Figure 7:
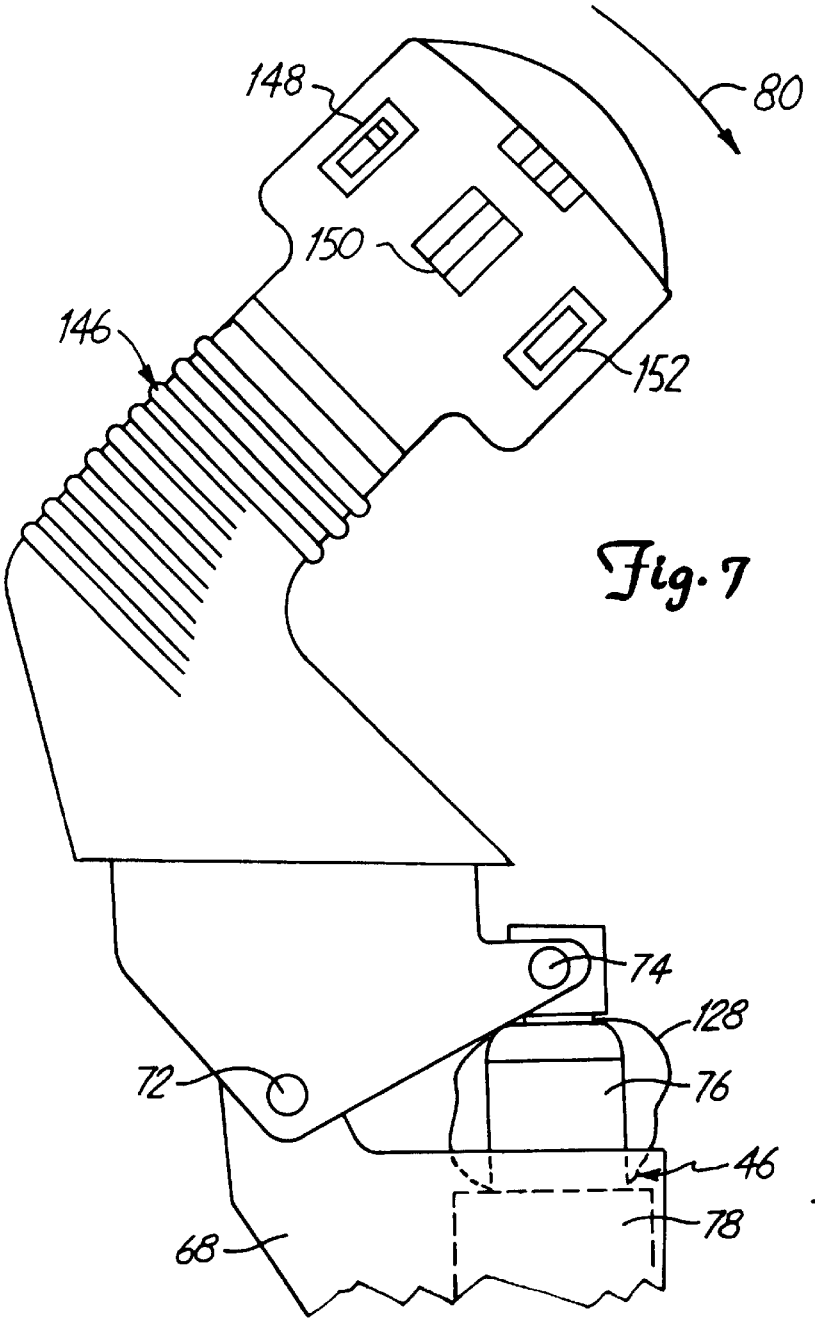
FIG. 7 is a second embodiment of a hand grip assembly according to the present invention.

FIG. 7 illustrates another feature useable with position sensor 46. FIG. 7 shows that handle 66 is fitted with an ergonomic hand grip 146. The hand grip 146 shown in FIG. 7 is a left handed grip. A number of switches 148, 150 and 152 are preferably provided on hand grip 146 and can be actuated by the thumb of the operator. Other items are similar to those shown in the previous figures and are similarly numbered.

Actuator 50 and Valve Spool Position Sensor

Figure 8:
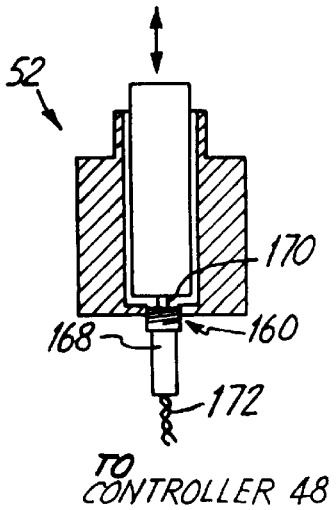
FIGS. 8A and 8B are illustration of a preferred embodiment of a valve spool position sensor according to the present invention.

One actuator which has been observed to be suitable as actuator 50 is a linear actuator more specifically described in the Nicholson et al. U.S. Pat. No. 5,187,993 which issued Feb. 23, 1993. Such a linear actuator is commercially available from Addco Manufacturing Inc. of St. Paul, Minn. Briefly, as illustrated in FIG. 8B the linear actuator has a motor 43 that receives an electrical input and causes corresponding rotation of a high pitch screw threaded shaft 45 in a cylinder frame. A push-pull rod 47 is connected with a threaded nut 49 which moves along the high pitch screw threaded shaft 45 in response to rotation of the shaft 45. This essentially transforms the rotational motion of the motor into linear movement. The push-pull rod 47 from the actuator is preferably coupled to valve spool 52 to cause linear positioning of valve spool 52 in response to the control signal from controller 48. Controller 48 preferably provides a pulse width modulated signal to actuator 50 to control actuator 50 as a function of the position signal provided by position sensor 46.

Actuator 50 also has a tab 51 and resistive strip 53 arrangement similar to that described with respect to position sensor 46. The electrical signals output by that arrangement are provided as the feedback signal to controller 48 so that controller 48 can determine the position of valve spool 52.

FIG. 8B illustrates another preferred embodiment in which actuator 50 need not have any type of position sensing mechanism. Rather, valve spool 52 is fitted with a position sensor arrangement 160 which can be similar to position sensor 46. A plunger 170 is provided at the base of the valve spool 52 and is urged against the base of the valve spool 52. The plunger 170 moves along a linear resistor 168 and provides an output on conductors 172 which is indicative of the position of plunger 170 relative to linear resistor 168. This signal is provided to controller 48. Based on this signal, controller 48 determines the precise position of valve spool 52. This arrangement essentially acts as a linear potentiometer.

Controller 48 monitors the feedback signal and controls actuator 50 in a similar fashion to that with respect to the position signal fed forward from position sensor 46. In other words, upon power-up, controller 48 reads the position of actuator 50 (or valve spool 52) and determines whether it is within a desired, predetermined range. If not, controller 48 provides a signal to interface controller 64 indicating that interface controller 64 should maintain loader 10 in a locked state.

However, if the position of actuator 50 (or valve spool 52) is within the desired neutral range, then controller 48 centers the control band around the neutral position read by controller 48. As with the embodiment shown in FIGS. 6A and 6B, this is typically done by simply subtracting or adding a desired value to the signal actually read from the A/D converter in the position sensor which senses the position of actuator 50 (or valve spool 52). Then, when controller 48 receives a desired position signal from position sensor 46, it controls actuator 50 (or valve spool 52) until the feedback signal indicates that the position of valve spool 52 is at the desired position. Again, controller 48 preferably controls actuator 50 (or valve spool 52) within plus or minus one count of the desired value.

Also, controller 48 controls actuator 50 (or valve spool 52) in one of two ways at the extreme end of travel. In other words, if controller 48 receives a value from position sensor 46 indicating that controller 48 is to drive the actuator 50 (or valve spool 52) to a point which is beyond one of the extreme ends of travel of actuator 50 (or valve spool 52), controller 48 controls in one of two ways. In the preferred embodiment, controller 48 drives actuator 50 (or valve spool 52) to the extreme end of travel and monitors movement. If it does not move for some predetermined length of time (such as 100 milliseconds), then controller 48 simply stops actuator 50 (or valve spool 52) at that position. In another, more simple embodiment, controller 48 simply continually tries to drive actuator 50 (or valve spool 52) to the requested position, regardless of whether the requested position is beyond one of the extreme ends of travel.

Alternative Hand Grip 44

Figure 9A:
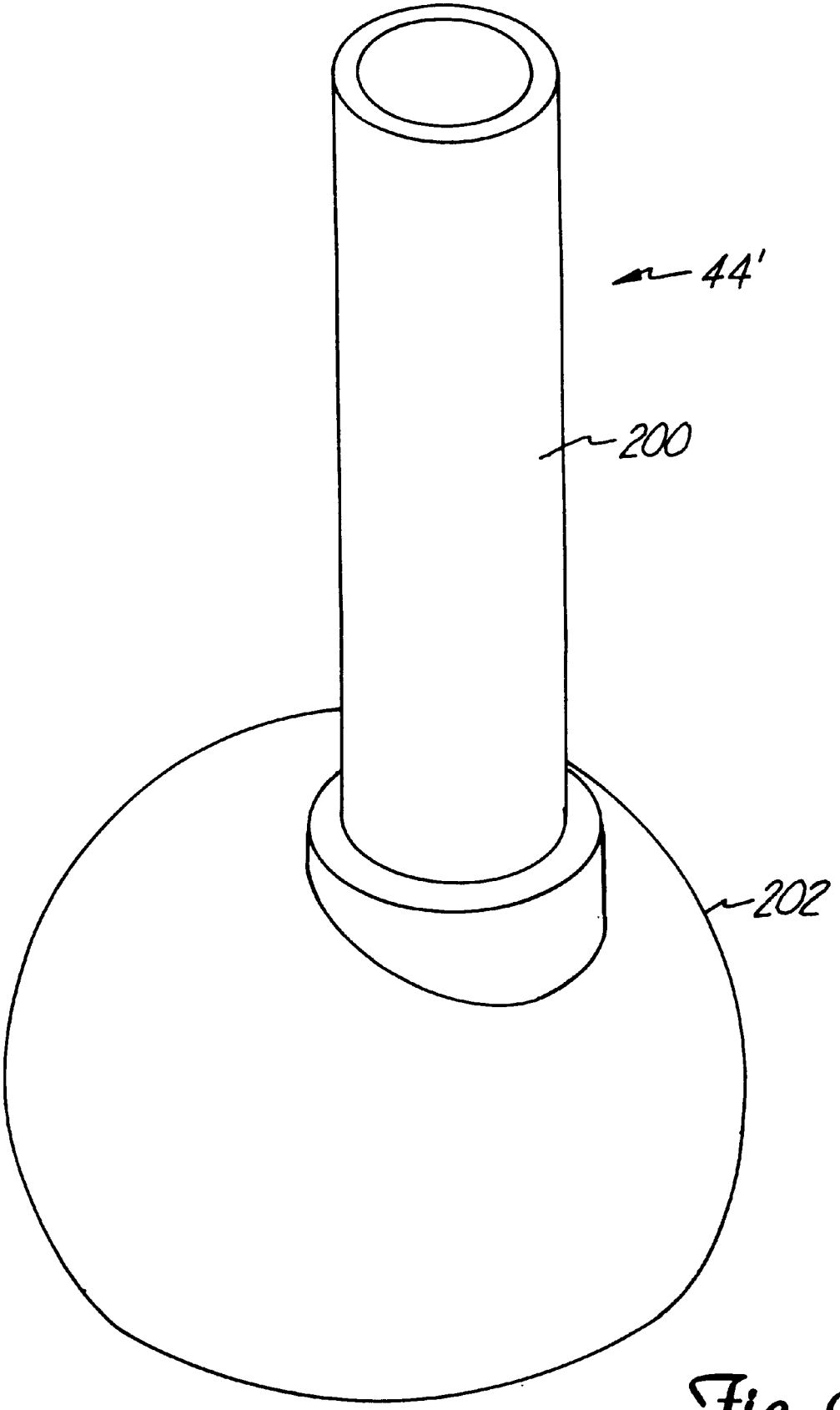
FIGS. 9A and 9B are a perspective view and side view, respectively, of another embodiment of a hand grip assembly according to the present invention.
Figure 9B:
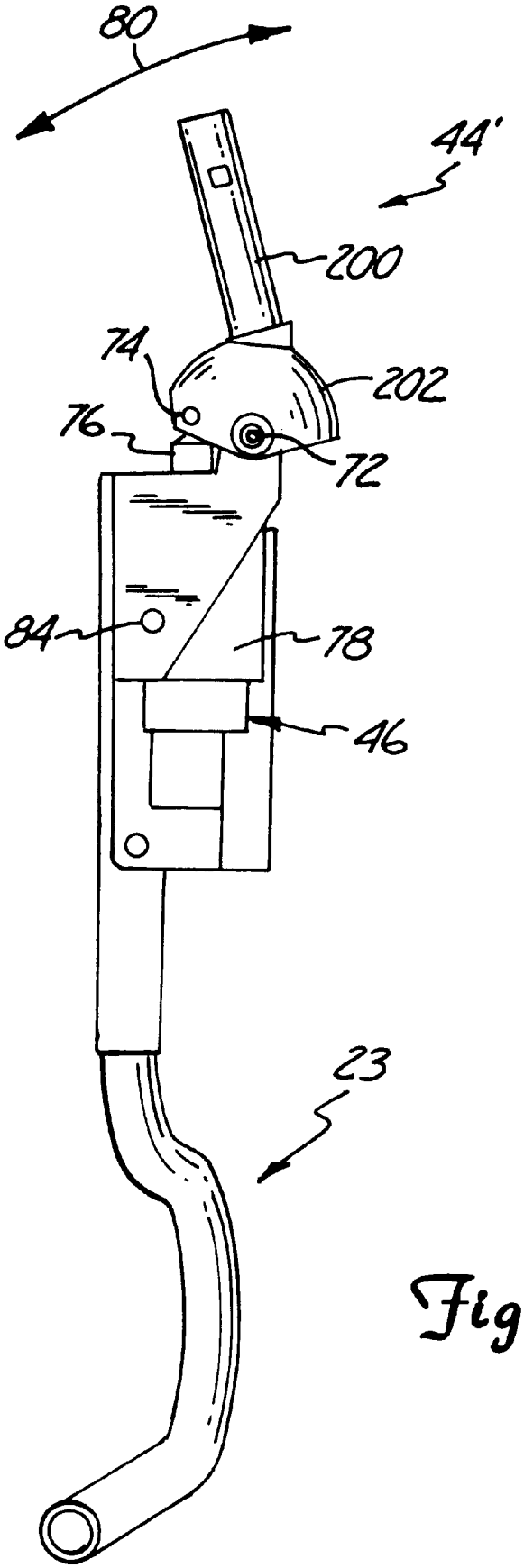

FIGS. 9A and 9B are a perspective view and side view, respectively, of another embodiment of a hand grip assembly 44' according to the present invention. FIGS. 9A and 9B illustrate hand grip assembly 44' implemented as a right hand grip mounted on a right hand steering lever 23. Hand grip assembly 44' is similar to hand grip assembly 44, and similar items are similarly numbered. However, hand grip assembly 44' includes a handle portion 200 which includes base portion 202. In the preferred embodiment, handle portion 200 and base portion 202 are integrally formed with one another by die casting. This allows hand grip assembly 44' to be manufactured very accurately, and with minimal machining.

Base portion 202, in the preferred embodiment, is a substantially hemispheric section. This allows the operator to grasp both handle 200 and base portion 202 at the same time. Because of the large contact area between the operator's hand and hemispheric base portion 202, the operator can achieve very fine control. It should also be noted that handle 200 is slightly skewed from base portion 202. This allows an ergonomic fit between handle 200 and the operator's hand.

Although the present invention has been described with reference to preferred embodiments, workers skilled in the art will recognize that changes may be made in form and detail without departing from the spirit and scope of the invention.

What is claimed is:

1. A control system for controlling actuation of a hydraulic cylinder on a skid steer loader, the control system comprising:

a movable element;

a position sensor coupled to the movable element and providing a movable element position signal indicative of a position of the movable element;

a controller, coupled to the position sensor to receive the movable element position signal, providing a control signal based on the movable element position signal;

a valve spool controlling flow of hydraulic fluid to the hydraulic cylinder;

an actuator coupled to the controller and the valve spool, the actuator moving the valve spool in response to the control signal from the controller; and wherein the controller is configured to determine an initial position of the movable element, upon power-up, and provide a signal to inhibit actuation of the hydraulic cylinder until the movable element is placed in a neutral position for a desired predetermined time period after power-up.

2. The control system of claim 1 wherein the skid steer loader is steerable by movement of one of a plurality of steering levers mounted therein, and wherein the movable element comprises a hand grip mounted to a first of the plurality of steering levers and movable relative to the first steering lever.

3. The control system of claim 1 wherein the movable element comprises a foot pedal.

4. The control system of claim 1 wherein the movable element comprises a selected one of a hand grip and a foot pedal, and further comprising:

a selector, coupled to the controller for selecting the one of the hand grip and the foot pedal.

5. The control system of claim 1 and further comprising:

a feedback loop, coupled to the controller, providing a valve position signal indicative of a position of the valve spool, and wherein the controller provides the control signal based on the valve position signal and the movable element position signal.

6. The control system of claim 5 wherein the feedback loop comprises:

an actuator position sensor coupled to the actuator and the controller and providing the valve position signal as an actuator position signal indicative of a position of the actuator.

7. The control system of claim 5 wherein the feedback loop comprises:

a valve spool position sensor, coupled to the valve spool and providing the valve position signal.

8. The control system of claim 5 wherein the feedback loop comprises:

first and second portions, movable relative to one another in response to movement of the actuator;

a resistive element mounted to one of the first and second portions; and a tab element mounted to another of the first and second portions;

wherein relative movement of the first and second portions causes interaction of the resistive element and the tab element to provide a varying electrical signal indicative of a position of the first and second portions relative to one another.

9. The control system of claim 8 wherein the actuator is a linear actuator and wherein the resistive element comprises a resistive strip mounted to one portion of the linear actuator and wherein the tab element comprises a conductive portion deformable to contact the resistive strip, and a tab mounted to a second portion of the linear actuator to deform the conductive portion at a position therealong based on relative position of the first and second portions of the linear actuator.

10. The control system of claim 1 wherein the controller provides the control signal to cause the actuator to move the valve spool to a float position allowing the hydraulic cylinder to float in response to the movable element position signal from the position sensor indicating that the hand grip has been moved to a predetermined position.

11. The control system of claim 10 wherein the movable element includes:

a detent for holding the movable element in the predetermined position.

12. The control system of claim 1 wherein the movable element comprises:

a bias member biasing the movable element in a neutral position.

13. The control system of claim 1 wherein the position sensor comprises:

first and second portions, movable relative to one another in response to movement of the movable element;

a resistive element mounted to one of the first and second portions; and a tab element mounted to another of the first and second portions;

wherein relative movement of the first and second portions causes interaction of the resistive element and the tab element to provide a varying electrical signal indicative of a position of the first and second portions relative to one another.

14. The control system of claim 5 wherein the controller is configured, upon power-up, to determine an initial position of the valve spool and control the actuator based on the initial position of the valve spool.

15. The control system of claim 1 and further comprising:

a second movable element;

a second position sensor coupled to the second movable element and providing a second movable element position signal indicative of a position of the second movable element;

the controller being coupled to the second position sensor to receive the second movable element position signal and providing a second control signal based on the second movable element position signal;

a second valve spool controlling flow of hydraulic fluid to a second hydraulic cylinder; and a second actuator coupled to the controller and the second valve spool, the second actuator moving the second valve spool in response to the second control signal from the controller;

wherein the hydraulic cylinder controls lifting of a lift arm on the skid steer loader and wherein the second hydraulic cylinder controls tilting of a bucket mounted to the lift arm.

16. A control system for controlling actuation of a hydraulic cylinder on a skid steer loader, the control system comprising:

a movable element;

a position sensor coupled to the movable element and providing a movable element position signal indicative of a position of the movable element;

a controller, coupled to the position sensor to receive the movable element position signal, providing a control signal based on the movable element position signal;

a valve spool controlling flow of hydraulic fluid to the hydraulic cylinder;

an actuator coupled to the controller and the valve spool, the actuator moving the valve spool in response to the control signal from the controller;

a feedback loop, coupled to the controller, providing a valve position signal indicative of a position of the valve spool, and wherein the controller provides the control signal based on the valve position signal and the movable element position signal; and wherein the feedback loop comprises an actuator position sensor coupled to the actuator and the controller and providing the valve position signal as an actuator position signal indicative of a position of the actuator.

* * * * *